United States Patent [19]

Iwans

[11] 4,114,207

[45] Sep. 19, 1978

[54] TOILET

[75] Inventor: Robert C. Iwans, Farmington, Conn.

[73] Assignee: Koehler-Dayton, Inc., New Britain, Conn.

[21] Appl. No.: 816,585

[22] Filed: Jul. 18, 1977

[51] Int. Cl.[2] ..... E03D 9/10; B01D 21/00

[52] U.S. Cl. ..... 4/319; 4/321; 210/152; 210/532 R

[58] Field of Search ..... 4/1, 10–12, 4/76–80, 89, 90, 95, 115, DIG. 19, 300, 317–323, 430, 431; 210/152, 157–159, 167, 412, 532 R, 532 S

[56] References Cited

U.S. PATENT DOCUMENTS

| | | | |
|---|---|---|---|
| 3,423,766 | 1/1969 | Eger | 4/115 |
| 3,579,651 | 5/1971 | Russo | 4/10 X |
| 3,666,103 | 5/1972 | Green | 4/10 X |
| 3,834,536 | 9/1974 | Kelsey | 210/152 X |
| 4,013,558 | 3/1977 | Rosenberg | 210/152 X |

*Primary Examiner*—Stuart S. Levy
*Attorney, Agent, or Firm*—Spencer T. Smith

[57] ABSTRACT

A toilet system comprising a collecting tank, a pump extending downwardly into the collecting tank and having an inlet, a drain opening in the bottom surface of the collecting tank a selected distance beneath the pump inlet and having a size sufficient to receive large glass objects therein, a drain conduit extending downwardly from the drain opening, the pump including a recirculating conduit, the recirculating conduit being selectively positioned and having a selected size for discharging pumped liquid across the pump inlet whereby bottles which are being drawn upwardly into the pump opening will be deflected downwardly through the drain opening into the drain conduit.

2 Claims, 2 Drawing Figures

Fig_1
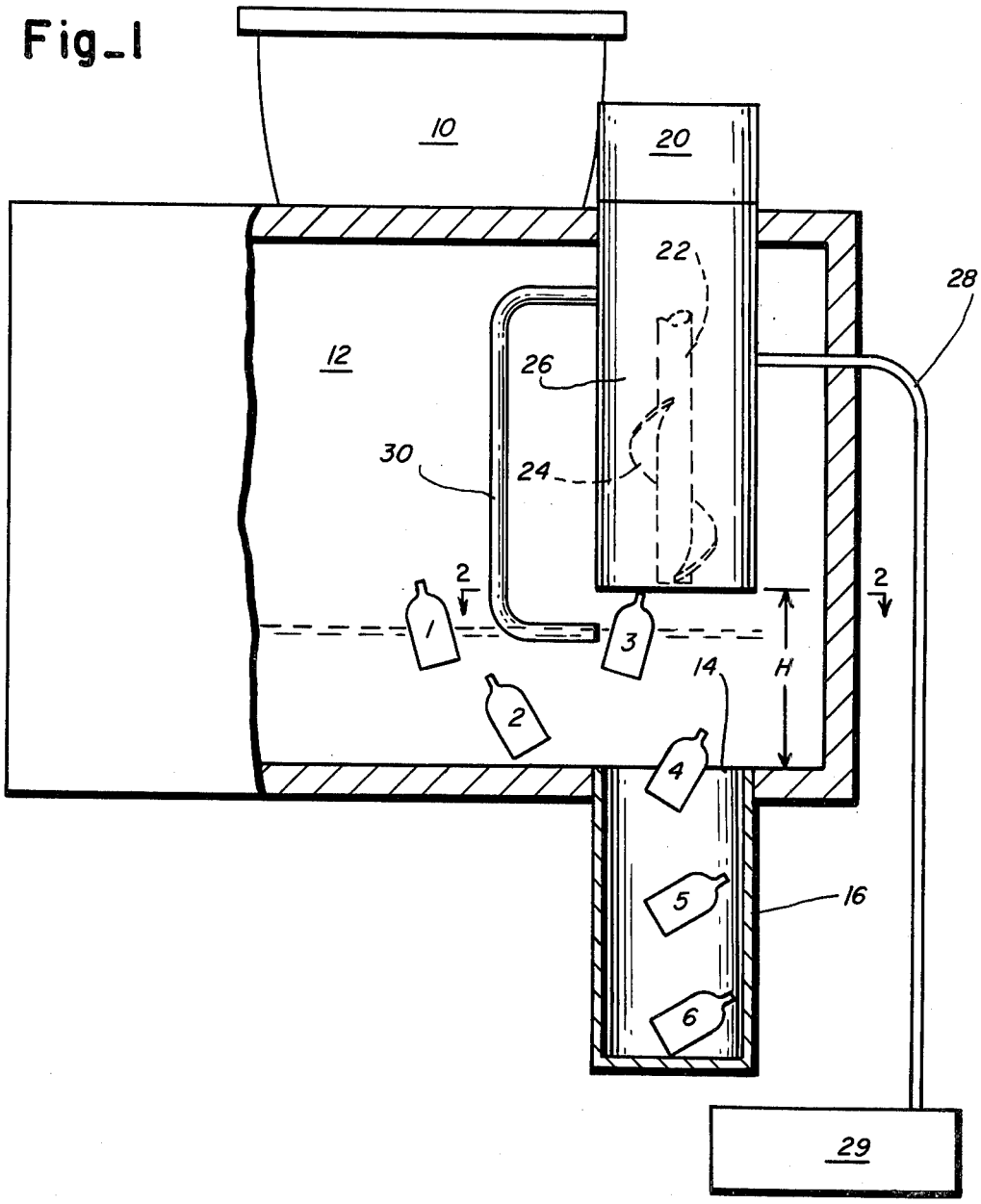
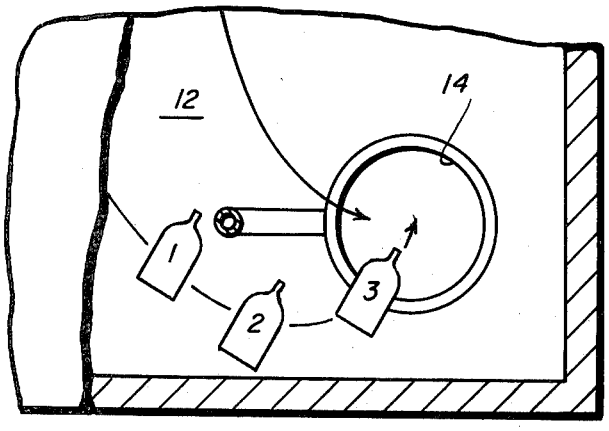
Fig_2

TOILET

The present invention relates to toilets which are found in vehicles such as trains, buses, and planes wherein pumps are utilized to convey the contents of a toilet collecting tank to a remote holding tank.

These toilet systems serve as a popular receptacle for glass products such as small liquor bottles, which, when pulled into the inlet of these pumps, cause substantial damage.

It is accordingly an object of the present invention to provide a toilet system wherein these glass products will be prevented from entering the pump inlet.

Among the advantages of the present invention is the collection of these glass products at a location which assures their subsequent removal from the toilet system during its routine maintenance.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawing:

FIG. 1 illustrates, in an elevational view, a toilet system made in accordance with the teachings of the present invention; and FIG. 2 is a view taken along the lines 2—2 of FIG. 1.

The toilet system includes a toilet bowl 10, which discharges into a collecting tank 12. The collecting tank 12 conventionally has a drainage opening 14 which communicates with a large drain pipe or conduit 16 through which the contents of the collecting tank may be drained during periodic maintenance. This drainage opening 14 is located proximate to one corner of the collecting tank.

Whenever a portion of the contents of the collecting tank 12 is to be removed and delivered to a remote holding tank or the like, a pump, which is driven by a motor 20, is operated for an interval of time. The pump includes a rotatable shaft 22 which supports impellers or blades 24. The shaft 22 axis lies directly above the center of the drainage opening 14. Concentrically surrounding these impellers and extending from the top of the collecting tank to a selected distance H from the bottom of the collecting tank is a pump housing or macerator tube 26. The pump discharges the pumped and macerated contents through a discharge conduit 28 which communicates with a holding tank 29 or the like.

As illustrated, the impellers 24 rotate in a counter-clockwise direction creating a counter-clockwise flow pattern toward the macerator tube 26. A bottle or the like, caught in this flow pattern will be displaced along the path 1-2-3.

Pumped and macerated liquid is recirculated under pressure from the pump through a recirculating conduit 30 to the mouth of the macerator tube. This recirculating conduit discharges in a substantially horizontal direction proximate to the bottom of the macerator tube so as to strike the top portion of a bottle being drawn into the macerator tube opening.

The distance H separating the bottom of the macerator tube 26 from the bottom of the collecting tank is selected to be small enough so that bottles deflected downwardly by the discharge of the recirculating conduit will enter the drain conduit 16, which is basically filled with still fluid, and there fall by gravity to the bottom of the drain conduit or pipe (bottle path 4-5-6).

The volume of fluid recirculated through the recirculating conduit is selected to impart a sufficient downward thrust on a bottle approaching the macerator tube inlet to assure its entry into the drainage conduit or pipe 16. In the preferred embodiment, 80% of the pumped and macerated liquid is recirculated.

What is claimed is:

1. A toilet system comprising a collecting tank, a pump extending downwardly into the collecting tank and having an inlet of sufficient size to permit entry of bottles thereinto, a continuously open opening in the bottom surface of said collecting tank directly beneath said pump inlet and having a size sufficient to receive large glass objects therein, the pump and bottom surface being sufficiently spaced to permit passage of bottles between the pump and bottom surface of the collecting tank, a normally closed drain conduit extending downwardly from said opening, said pump including discharge and recirculating conduits, said pump conjointly delivering pressurized liquid to said drain and recirculating conduits, said recirculating conduit being selectively positioned and having a selected size for discharging pumped liquid across the pump inlet whereby bottles which are being drawn upwardly into the pump opening will be deflected downwardly through said drain opening into said drain conduit.

2. A toilet system according to claim 1, wherein said pump and drain conduit are coaxial.

* * * * *